US007412070B2

(12) United States Patent
Kleinschmidt et al.

(10) Patent No.: US 7,412,070 B2
(45) Date of Patent: Aug. 12, 2008

(54) HEADPHONING

(75) Inventors: David Kleinschmidt, Natick, MA (US); Leonid Pavlotsky, Needham, MA (US); Roman Sapiejewski, Boston, MA (US)

(73) Assignee: Bose Corporation, Framingham, MA (US)

( * ) Notice: Subject to any disclaimer, the term of this patent is extended or adjusted under 35 U.S.C. 154(b) by 992 days.

(21) Appl. No.: 10/812,042

(22) Filed: Mar. 29, 2004

(65) Prior Publication Data

US 2005/0213774 A1 Sep. 29, 2005

(51) Int. Cl.
*H04R 25/00* (2006.01)
*H04R 1/10* (2006.01)

(52) U.S. Cl. ..... 381/374; 381/370; 381/74

(58) Field of Classification Search ..... 381/71.1, 381/71.6, 72, 74, 77, 83, 93, 370, 371, 376, 381/377, 378, 384; 700/94; 379/430
See application file for complete search history.

(56) References Cited

U.S. PATENT DOCUMENTS

| | | | |
|---|---|---|---|
| 3,902,120 A | 8/1975 | Dascal et al. | |
| 4,455,675 A | 6/1984 | Bose et al. | |
| 4,499,593 A | 2/1985 | Antle et al. | |
| 4,644,581 A | 2/1987 | Sapiejewski | |
| 4,922,542 A | 5/1990 | Sapiejewski | |
| 4,989,271 A | 2/1991 | Sapiejewski et al. | |
| 5,181,252 A | 1/1993 | Sapiejewski et al. | |
| 5,208,868 A | 5/1993 | Sapiejewski | |
| 5,305,387 A | 4/1994 | Sapiejewski | |
| 5,675,658 A | 10/1997 | Brittain et al. | |
| 6,236,732 B1 | 5/2001 | Griffith | |
| 6,597,792 B1 | 7/2003 | Sapiejewski et al. | |
| 7,215,766 B2 * | 5/2007 | Wurtz | 379/430 |

FOREIGN PATENT DOCUMENTS

| | | |
|---|---|---|
| EP | 0895439 | 2/1999 |
| WO | WO 02/080504 | 10/2002 |

OTHER PUBLICATIONS

EP Search Report in corresponding Application No. 05100954.6 dated Oct. 17, 2006.

* cited by examiner

*Primary Examiner*—Brian Ensey
(74) *Attorney, Agent, or Firm*—Fish & Richardson P.C.

(57) ABSTRACT

A noise reducing headset has one or more of the following features: (a) pair of earcups each seated in a yoke assembly mechanically coupled by a headband enclosing a flat spring formed with a slot that runs the length of the spring accommodating electrical wires electrically interconnecting electrical elements in the earcups, (b) each earcup having active noise reducing circuitry, (c) each earcup including a loudspeaker driver located off center in the earcup to allow an internal cavity inside each earcup to accommodate a loudspeaker driver, a microphone and an electronic printed circuit board and one of a battery and plug assembly, (d) one of the earcups accommodating a detachably secured plug assembly having a sensitivity switch covered by the earcup when the plug assembly is fully seated in the earcup, (e) the other earcup having a battery door that may be opened to allow insertion and removal of the battery and covered by a yoke assembly when the headset is worn by a user with the battery fully seated in the earcup.

4 Claims, 8 Drawing Sheets

HEADPHONING

The present invention relates in general to headphoning and more particularly concerns novel headphones especially advantageous in connection with active noise reducing but having features useful in passive headphones. A headset is a pair of headphones interconnected by a headband.

BACKGROUND OF THE INVENTION

For background, reference is made to U.S. Pat. Nos. 6,597,792, 5,305,387, 5,208,868, 5,181,252, 4,989,271, 4,922,542, 4,644,581 and 4,455,675. Reference is also made to the commercially available Bose QUIET COMFORT headset and the commercially available QUIET COMFORT 2 headphones. The QUIET COMFORT 2 headphones embody the invention disclosed herein and is incorporated by reference herein.

SUMMARY OF THE INVENTION

According to aspects of the invention, an active noise reducing headset is constructed and arranged with a replaceable battery in one earcup and a detachably securable plug having a switch and an audio cable with a plug at the end for mating engagement with a sound source jack in the other earcup. Both earcups have active noise reduction circuitry. Another feature of the invention is an enclosed headband spring embracing an electrical cable that intercouples electrical elements in the respective earcups. Still another feature of the invention is a loudspeaker driver offset from the center of the earcup adjacent to a printed circuit board carrying circuitry. Still another feature of the invention is a hinged battery access door that when closed is normally covered by the yoke arm assembly that pivotally supports the earcup.

Other features, objects and advantages of the invention will become apparent from the following detailed description when read in connection with the accompanying drawing, in which:

DETAILED DESCRIPTION

Figure 1:
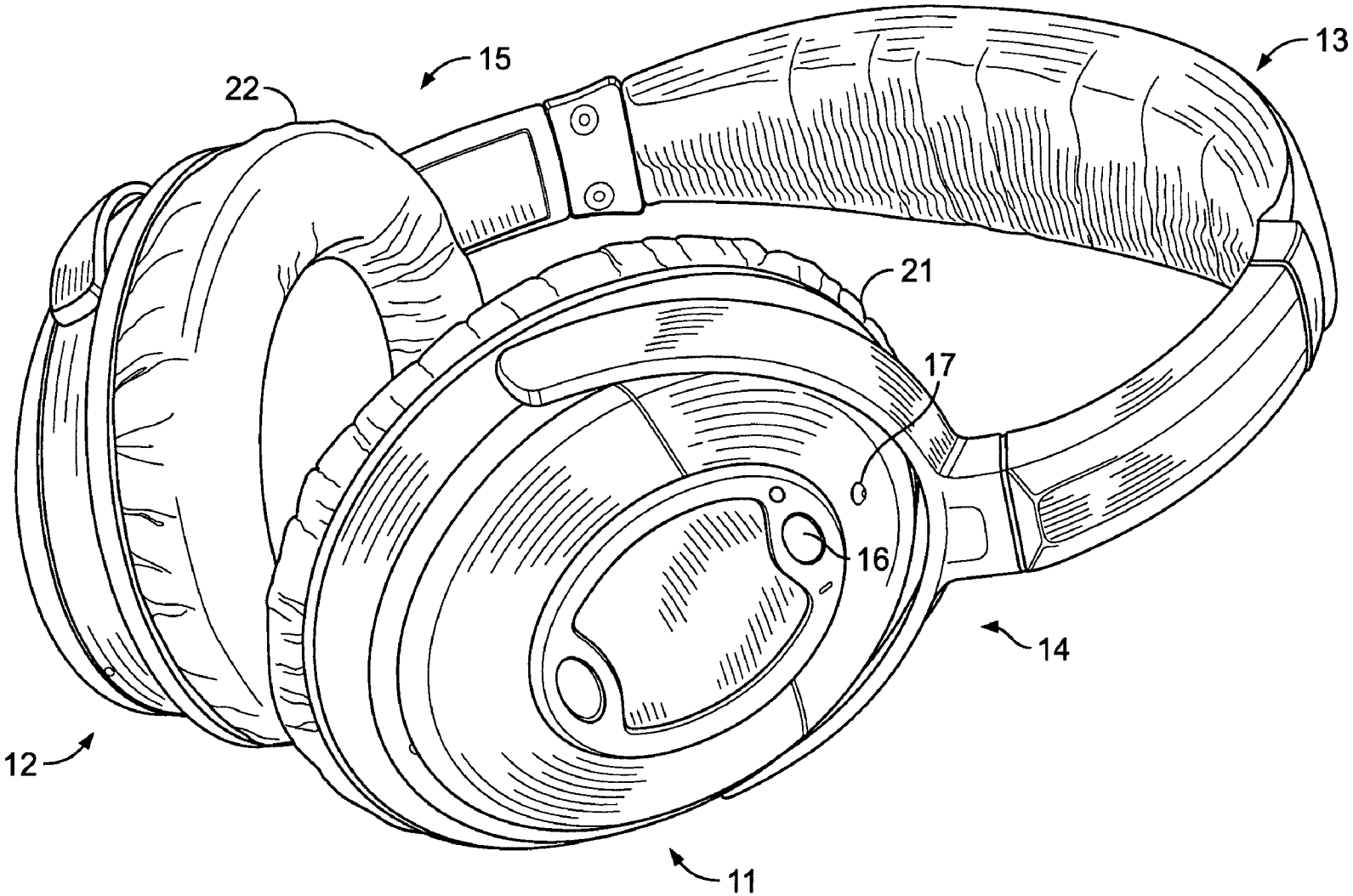
FIG. 1 is a perspective view of a commercially available Bose QUIET COMFORT 2 headphones embodying the invention.

With reference now to the drawing, and more particularly to FIG. 1 thereof, there is shown a perspective view of a commercially available Bose QUIET COMFORT 2 headphones embodying the invention. The headphones include a right earcup 11 and a left earcup 12 intercoupled by a headband 13 with a depending right yoke assembly 14 and left yoke assembly 15. The right earcup 11 includes a switch 16 and an LED 17 that is illuminated when switch 16 is in the on position. Right earcup 11 and left earcup 12 include right circumaural cushion 21 and circumaural left cushion 22, respectively.

Figure 2:
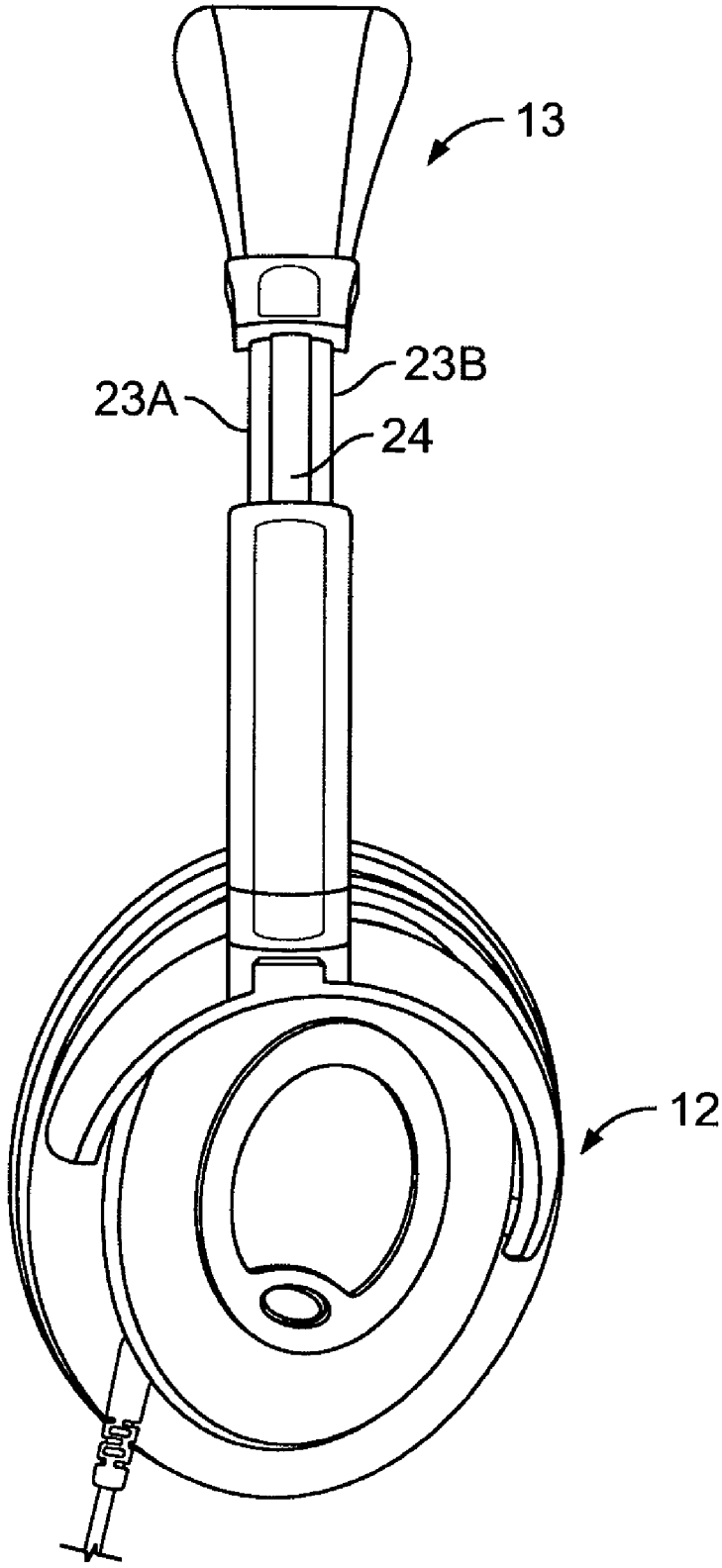
FIG. 2 is a side pictorial view illustrating a feature of the headband cable covered between two sections of flat spring.

Referring to FIG. 2, there is shown a pictorial view illustrating the feature of the headband cable 24 interconnecting electrical elements in the earcups covered between sections 23A and 23B of a flat spring that furnishes a clamping force to keep the earcups over the ears of a user. The interconnected electrical elements may comprise switch 16 and battery 37 in right earcup 11 (FIG. 4) and an electronic circuit board in left earcup 12. The same reference symbols identify corresponding elements throughout the drawing.

Figure 3:
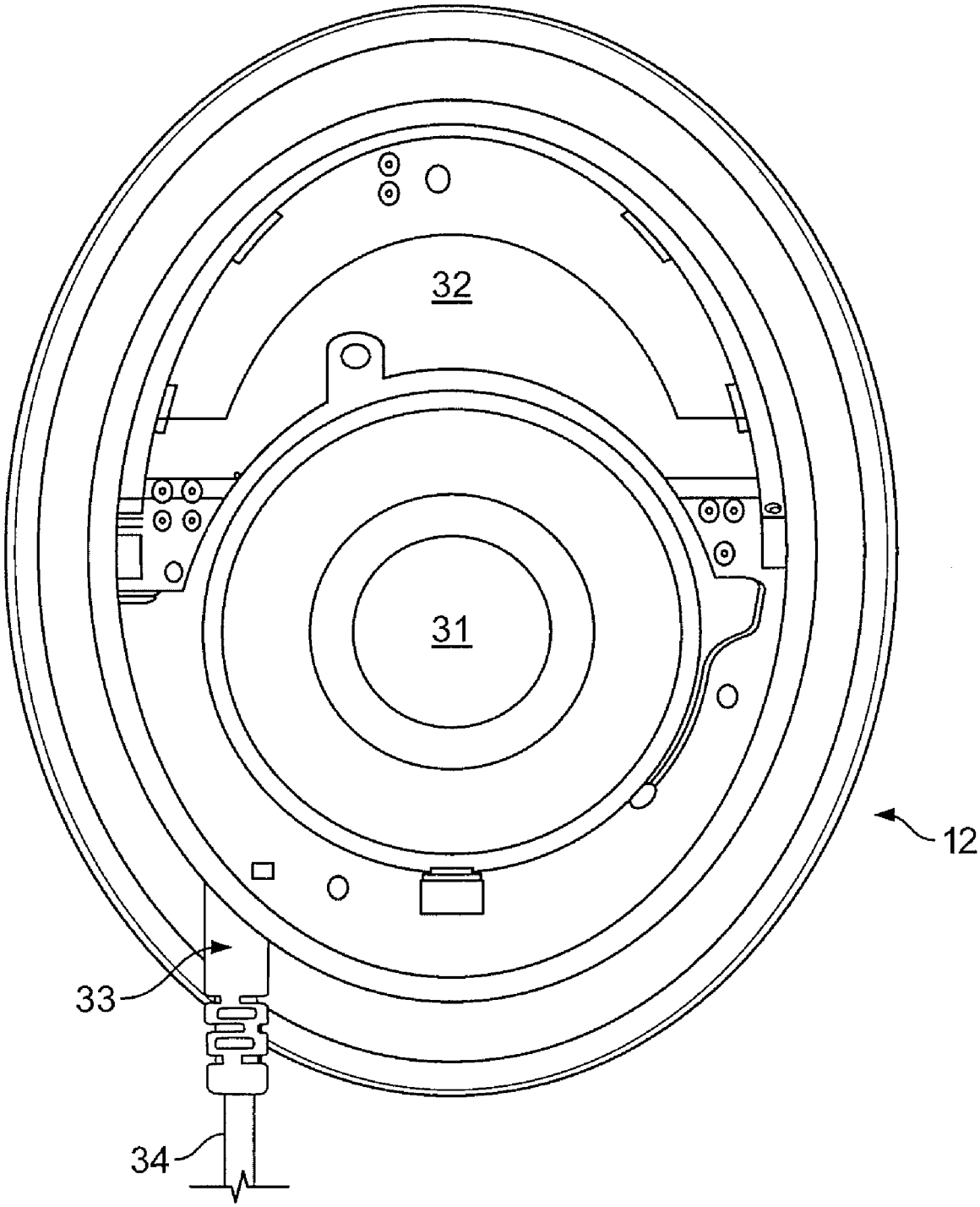
FIG. 3 is a pictorial view of an earcup according to the invention showing a feature of the loudspeaker driver off center.

Referring to FIG. 3, there is shown a pictorial view illustrating the feature of loudspeaker driver 31 mounted off-center in the earcup. Printed circuit board 32 is mounted above loudspeaker 31 in left earcup 12 that includes a detachably secured plug assembly 33 with appended cord 34 having a miniature stereo plug (not shown) at the other end for engagement with a mating jack that is connected to a source of audio signals, such as the sound channels in an aircraft or a CD player.

Figure 4:
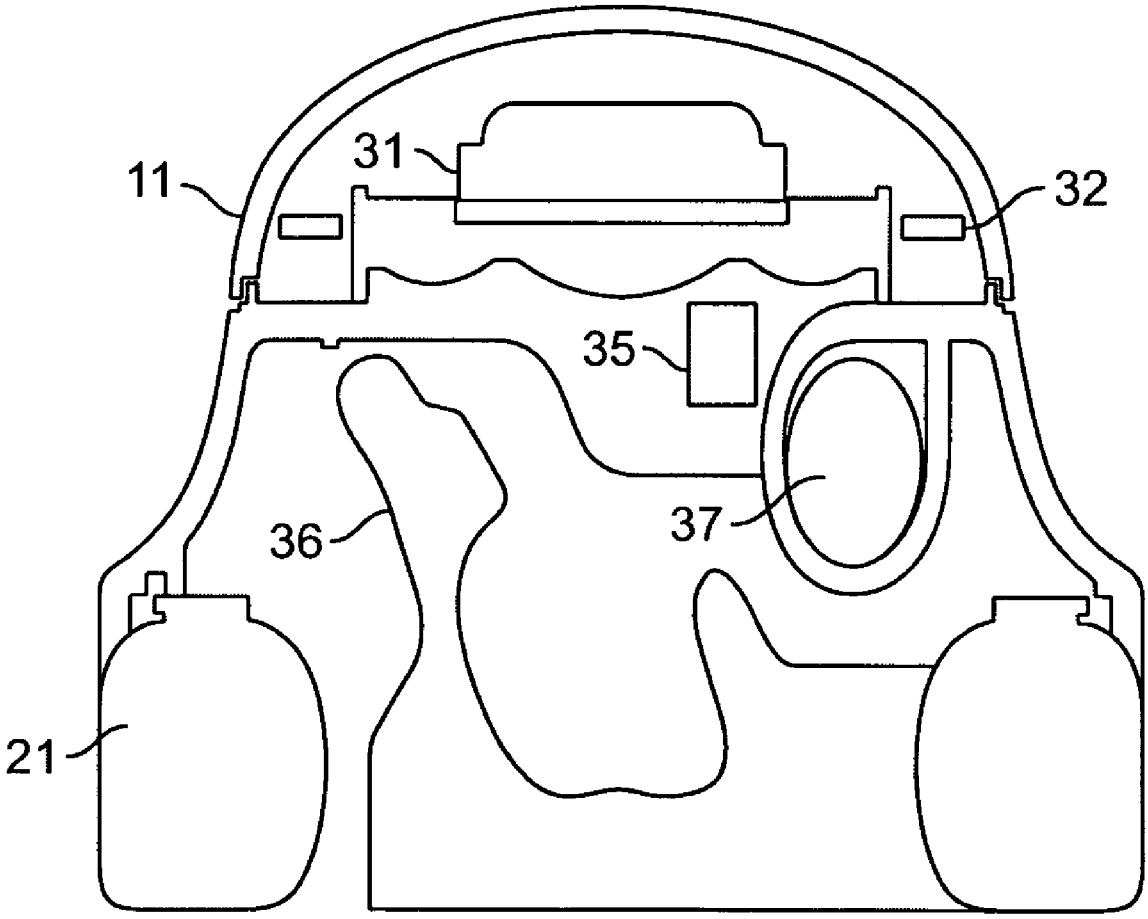
FIG. 4 is a diagrammatic cross-section through an earcup showing the feature of small earcup profile with space for the ear and internal components.

Referring to FIG. 4, there is shown a diagrammatic cross section through an earcup showing the compact earcup profile formed with space for the ear and internal components. Each earcup includes a loudspeaker driver 31 positioned as shown, a microphone 35 positioned as shown, an electronics printed circuit board 32 as shown, a plug assembly 33 in left earcup 12 and a battery 37 in right earcup 11 positioned as shown with the ear 36 accommodated and surrounded by a circumaural ear cushion 21, 22.

Figure 5:
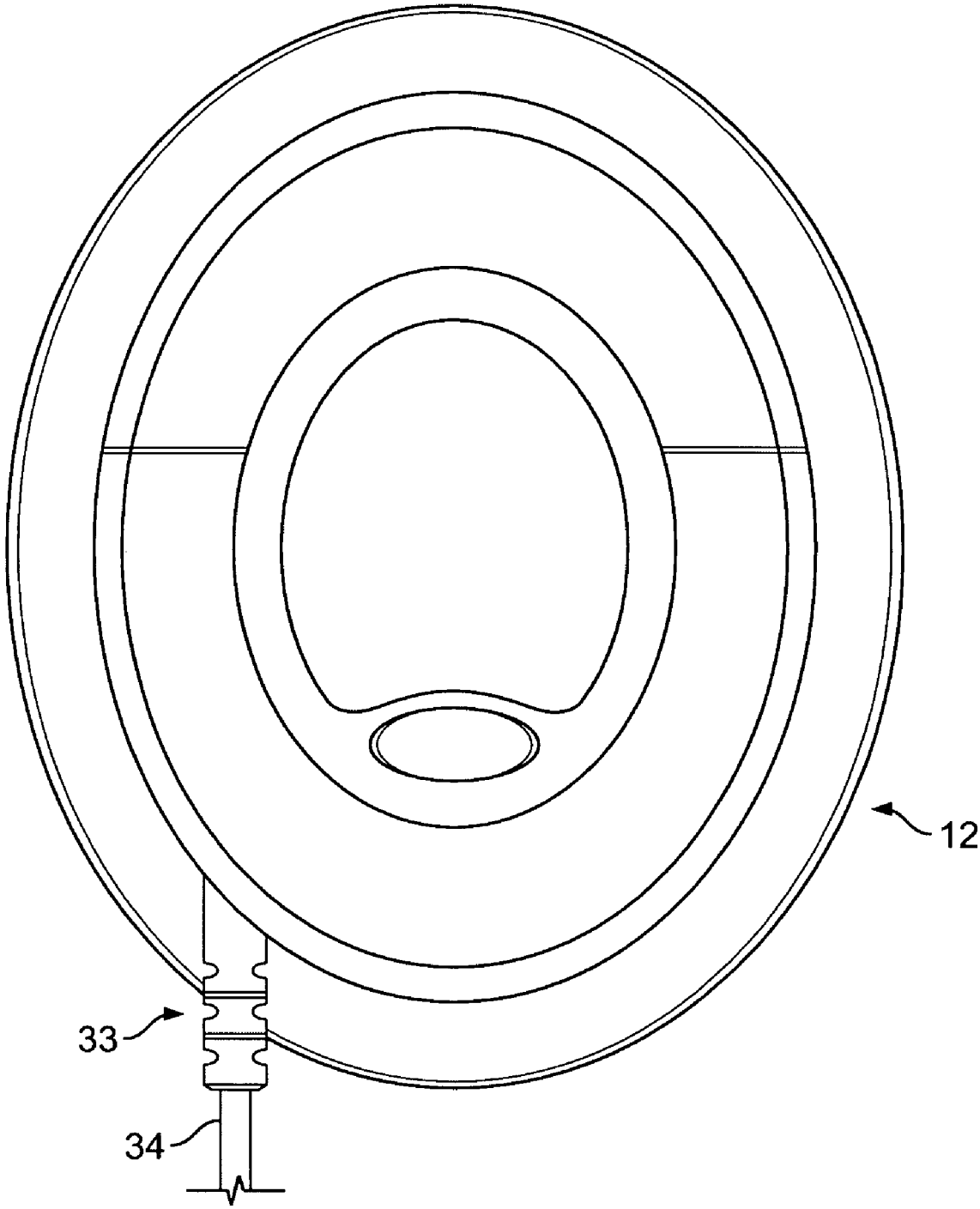
FIG. 5 is a pictorial view of an earcup illustrating the feature of the plug assembly with switch hidden.

Referring to FIG. 5, there is shown a pictorial view of left earcup 12 illustrating the location of plug assembly 33 that carries a high-low switch and is detachably secured to the earcup allowing relatively easy removal to select the switch position or to remove the cord when only noise reducing is desired so that the user may then move about while wearing the headphones illustrated in FIG. 1.

Figure 6:
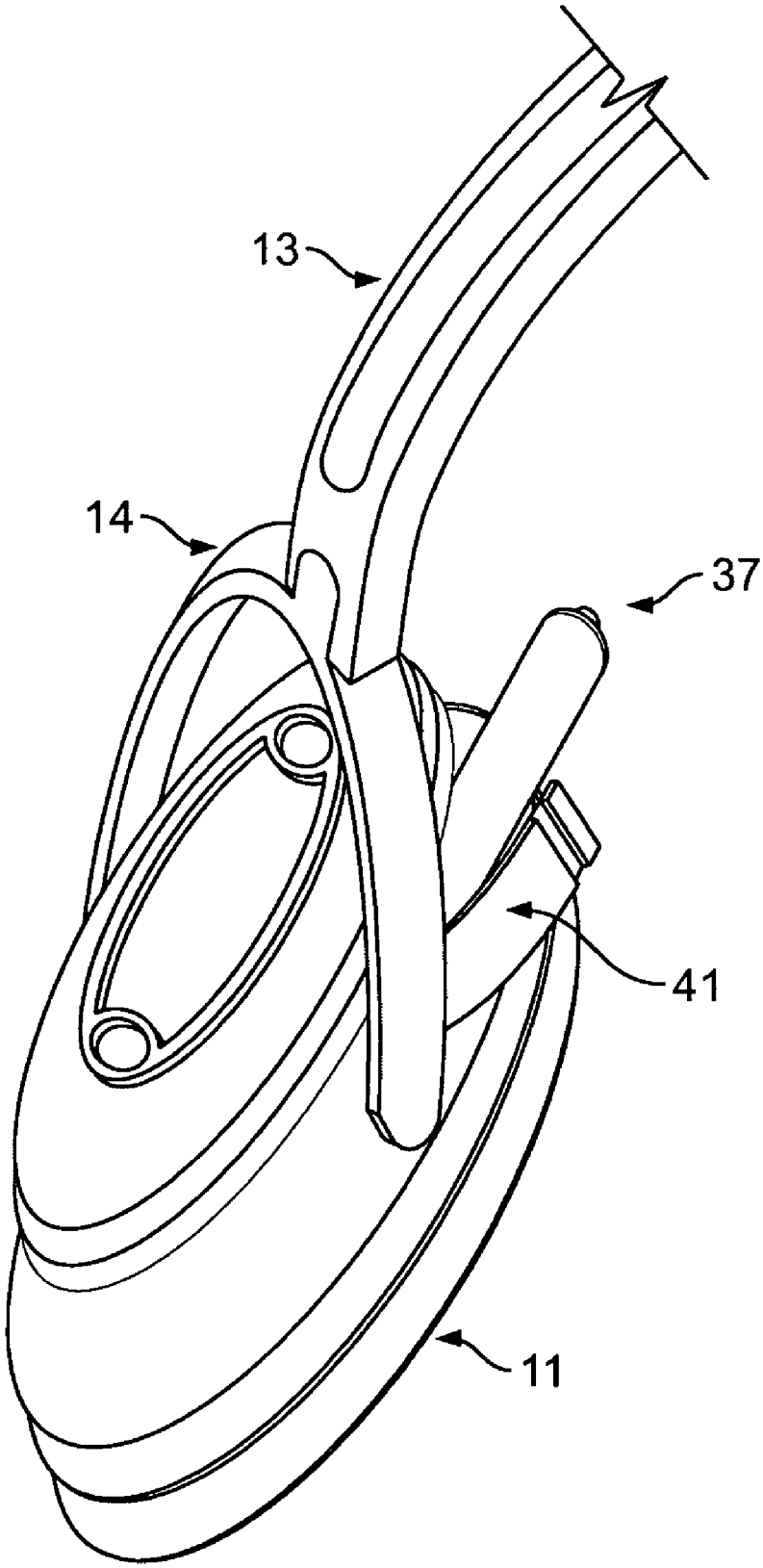
FIG. 6 is a pictorial view of an earcup yoke assembly showing the feature of the battery door on top protected by the headband yoke with the battery door open.

Referring to FIG. 6, there is shown a view of an earcup and yoke arm assembly illustrating how battery 37 is removably seated in earcup 11 with battery access door 41 in the open position. When battery 37 is fully inserted, battery access door 41 closes and is covered by yoke arm assembly 14 when the headphones are positioned on the head of a user with earcups embracing the ears.

Figure 7:
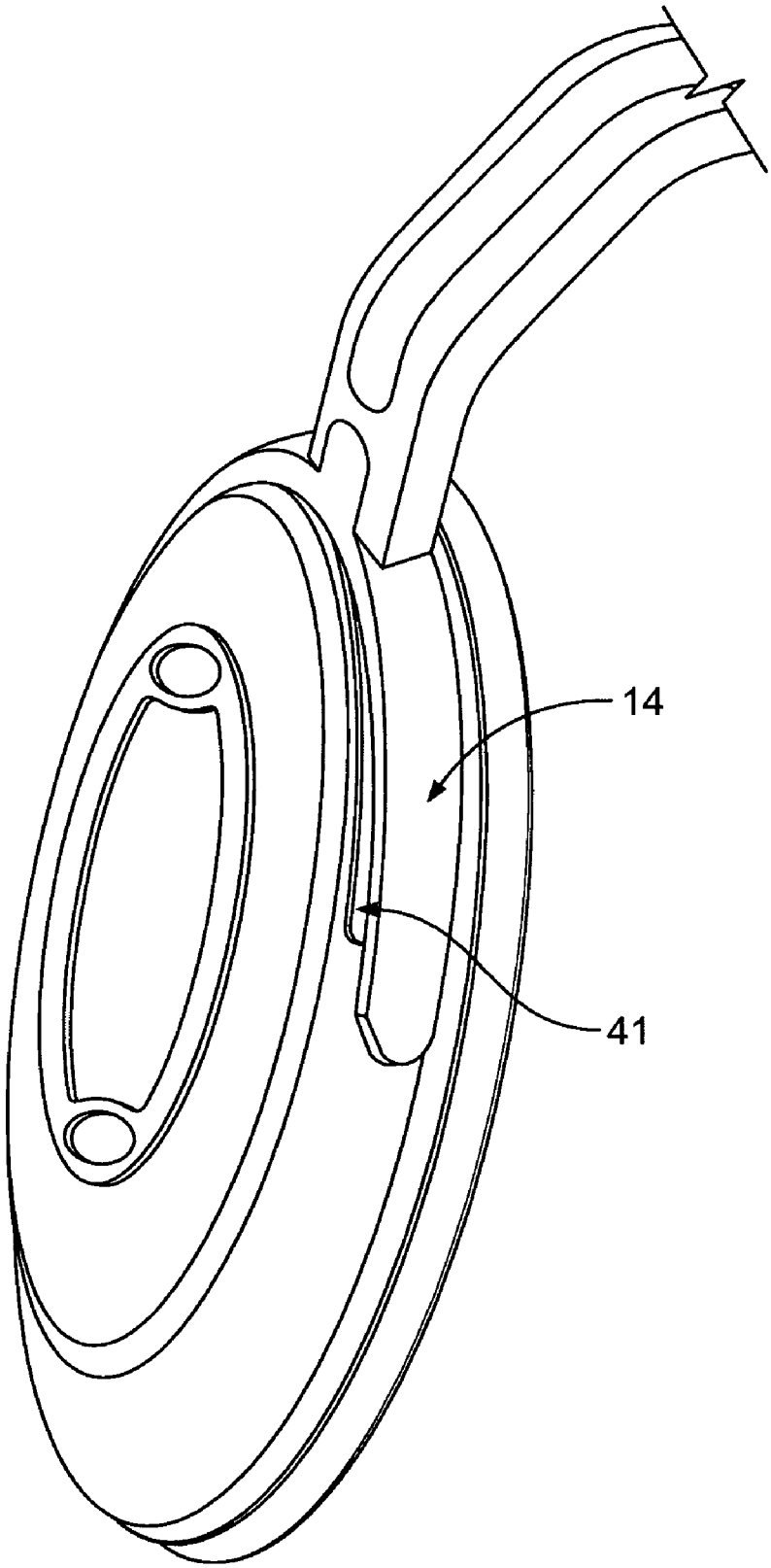
FIG. 7 is a pictorial view of an earcup yoke assembly showing the feature of the battery door on top protected by the headband yoke with the battery door closed.

Referring to FIG. 7, there is shown the assembly of FIG. 6 with battery access door 41 closed and covered by yoke arm assembly 14.

Figure 8:
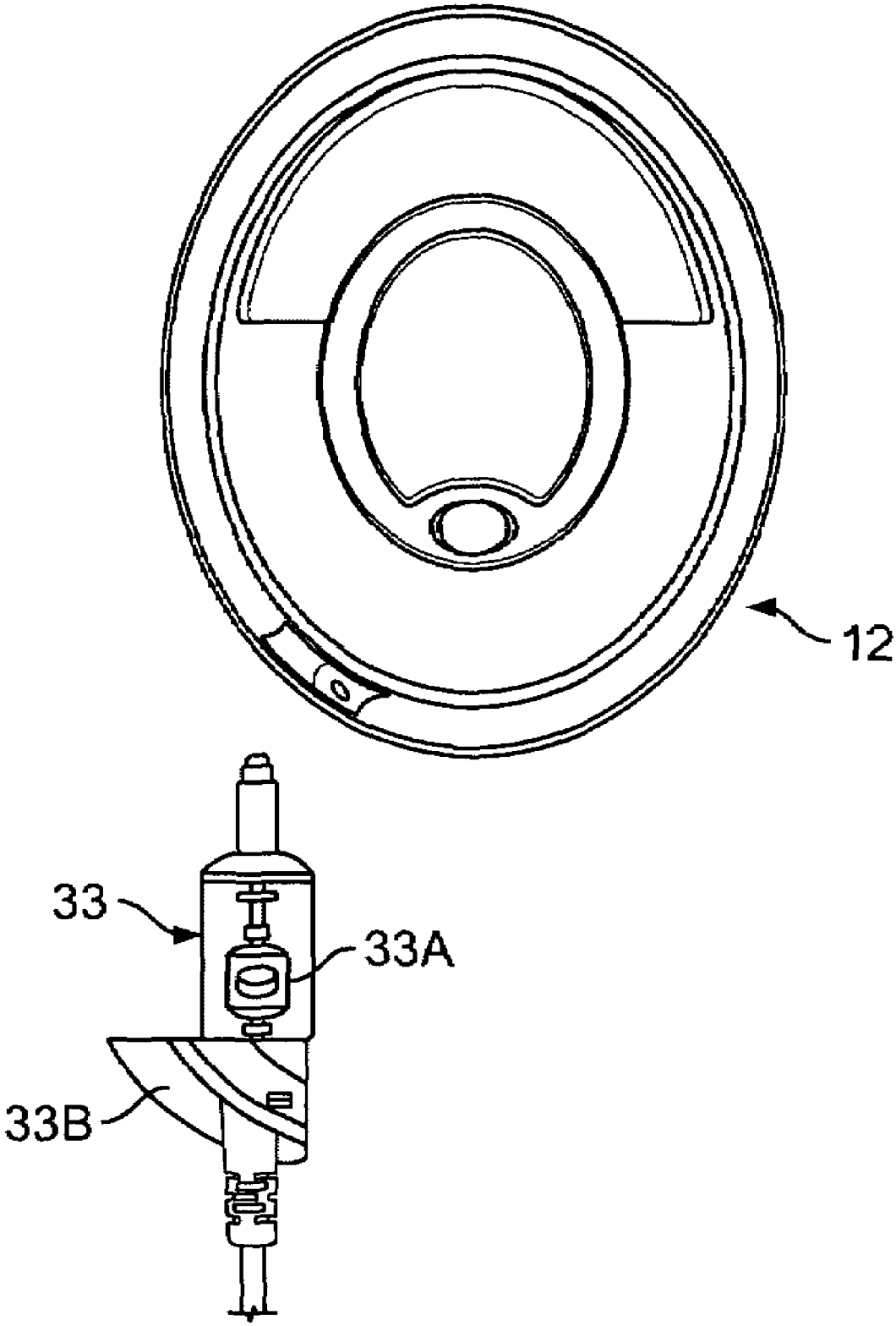
FIG. 8 is a pictorial view showing the plug assembly with switch removed from the earcup.

Referring to FIG. 8, there is shown a view of left earcup 12 with plug assembly 33 removed to illustrate how sensitivity switch 33A is positioned to switch in a resistor for lower sensitivity and switch out the resistor for higher sensitivity (resistor not shown) and section 33B that smoothly covers the opening when plug assembly 33 is fully seated in earcup assembly 12.

The invention has a number of advantages. Locating the battery door on the top of an earcup makes it difficult for a battery to inadvertently fall from the cup with the yoke over the battery door when the headphones are in use for the battery door cannot open. The flat spring for providing clamping force provides a desired clamping force while keeping the width and weight of the spring low. A slot that runs the length of the headband spring conveniently accommodates the wires interconnecting the earcups and may be covered by a protective plastic. The earcups have a relatively small profile while furnishing desired cavity volumes by vertically orienting the battery and attenuator/plug assembly and locating them forward in the earcups such that they are located in a region where there is no intrusion into the front cavity by the user's pinna. When the plug/attenuator assembly is inserted into the earcup, the switch available to control the volume or sensitivity of the headset is covered and not directly accessible by the user where it might be inadvertently switched to a different position. The loudspeaker drivers are offset from the center of the earcup and are located lower in the cup (although higher may be used). Using a round driver in a substantially round earcup and offsetting the driver towards one end or the other allows more room for location of a printed circuit board.

It is evident that those skilled in the art may now make numerous uses and modifications of and departures from the specific apparatus and techniques described herein without departing from the inventive concepts. Consequently, the invention is to be construed as embracing each and every novel feature and novel combination of features present in or possessed by the apparatus and techniques herein disclosed and limited only by the spirit and scope of the appended claims.

What is claimed is:

1. A noise reducing headset comprising, a pair of earcups each having electrical elements and seated in a yoke assembly mechanically coupled by a headband enclosing a flat spring formed with a slot that runs the length of the spring accommodating electrical wires electrically interconnecting electrical elements in the earcups, each earcup having active noise reducing circuitry, each earcup including a loudspeaker driver located off center in the earcup to allow an internal cavity inside each earcup to accommodate the loudspeaker driver, a microphone and an electronic printed circuit board and one of a battery and plug assembly, one of said earcups accommodating a detachably secured plug assembly having a sensitivity switch covered by the earcup when the plug assembly is fully seated in the earcup, the other earcup having a battery door that may be opened to allow insertion and removal of the battery and covered by a yoke assembly when the headphones are worn by a user with the battery fully seated in the earcup.

2. A noise reducing headset in accordance with claim 1 and further comprising plastic covering said slot with the wires therein.

3. A noise reducing headset in accordance with claim 1 and further comprising a circumaural cushion attached to each earcup constructed and arranged to surround the ear of a user.

4. A noise reducing headset comprising an earcup attached to a yoke assembly, said earcup having a battery door that may be opened to allow insertion and removal of a battery and covered by said yoke assembly when the headset is worn by a user with the battery fully seated in the earcup.

* * * * *